United States Patent [19]

Brown et al.

[11] Patent Number: 4,571,360

[45] Date of Patent: Feb. 18, 1986

[54] FOAM COMPOSITION USED IN PAPER TREATMENT

[75] Inventors: Russell L. Brown; George M. Bryant, both of Charleston; Charles J. Cunningham, Elkview, all of W. Va.

[73] Assignee: Union Carbide Corporation, Danbury, Conn.

[21] Appl. No.: 715,169

[22] Filed: Mar. 22, 1985

[51] Int. Cl.[4] ..... B32B 23/08

[52] U.S. Cl. ..... 428/318.4; 427/373; 427/391; 427/395; 428/342; 521/65; 521/82; 521/85

[58] Field of Search ..... 427/373, 391, 395; 428/318.4, 342; 521/65, 82, 85

[56] References Cited

U.S. PATENT DOCUMENTS

| | | | |
|---|---|---|---|
| 4,023,526 | 5/1977 | Ashmus et al. | 427/244 |
| 4,099,913 | 7/1978 | Walter et al. | 8/477 |
| 4,184,914 | 1/1980 | Jenkins | 427/391 |
| 4,263,344 | 4/1981 | Radvan | 427/391 |
| 4,353,993 | 10/1982 | McCrossin | 521/65 |

*Primary Examiner*—William J. Van Balen

*Attorney, Agent, or Firm*—Henry H. Gibson

[57] ABSTRACT

Foamable compositions having low concentrations of select foaming agents provide uniform distribution of paper treating agents onto moving paper, including high speed applications, and treated paper having unimpaired properties.

20 Claims, No Drawings

FOAM COMPOSITION USED IN PAPER TREATMENT

BACKGROUND OF THE INVENTION

1. Field of the Invention

This invention pertains to compositions and processes for treating fibrous substrates, such as moving paper webs during papermaking and finishing operations, and more particularly to foamable compositions containing paper treating agents used to provide treated paper.

2. Description of Background Information

The manufacture of paper, and similar flexible sheet materials, usually includes a treating step involving the application of treating agents to the preformed sheet or web as known to those in the art. Such paper treating agents, including performance or functional chemicals, can be added to assist the papermaking processing by adding process performance chemicals or can be added to the paper as product performance chemicals.

Paper treating agents applied to paper webs are usually dry solids as incorporated in the treated paper. The agents are, however, usually applied to the paper web as a fluid treating composition using a liquid vehicle to facilitate distribution, coverage and penetration of the treating agent onto the paper. Various procedures have been used to apply such fluid treating compositions during papermaking and finishing operations with limited success. Typically, the paper is passed through, or in contact with, the fluid composition thereby providing an excess of composition beyond the amount required. The excess composition is then "doctored off" using a coating thickness limiting device, such as a blade, gapped roll, air knife or the like. Alternatively, the paper is passed between squeeze rolls which, by pressure between the rolls, limits and controls the amount of applied fluid. In such processes, the reservoir or "pond" of fluid composition contacting the paper is continually recirculated using a large supply reservoir enabling consistent treatment. In addition, absorption of paper treating agents from liquid reservoirs followed by doctoring off the excess is dependent upon the moisture content of the paper web in enabling uniform absorption.

Additional limitations arise since paper, which is not precoated or presized, is usually relatively slow in wettability rates because of a "self-sizing" nature due to the presence of lignins and other natural wood materials. In typical first coating or sizing treatments, included within papermaking operations, the slow wettability of the paper is compensated for by using dilute compositions in large amounts to provide longer wetting time exposure. This is due to the general undesirability in including wetting agents for promoting paper wettability during such treating processes since wetting agents generally interfere with the desired physical properties of the treated paper and also may cause uncontrolled foaming in such liquid ponds. Such liquid composition applications therefore limit the rate at which the paper can be processed since: (1) time consuming drying operations following the treatment are required and (2) difficulty in obtaining uniform wetting of the treated paper limits high speed applications.

Additional limitations in the kinds of treating agents which can be applied by squeeze rolls arise due to various limitations in their use. Treating agent compositions must generally be low-viscosity, low-solids compositions since strong hydraulic forces generated in squeeze rolls at high speeds separate the rolls leading to loss of control in the amount of composition applied and other problems. Studies show that high-viscosity fluid penetration mechanisms govern pick-up such that a strength gradient from the paper surface to the sheet center develops generated non-uniform applications, unless saturation occurs.

Spraying paper treating agent compositions onto paper web has other limitations. Generally, only low-viscosity liquids can be utilized. Limitations in the uniformity of application of treating agent occur. In particular, uniform application of high-solid liquid treating compositions is extremely difficult to obtain since spray nozzle plugging by ingredients in the composition is a common problem. Sensitivity to spray nozzle design and performance, as well as inherent limitations in spray configurations and overlap, leads to inefficient distribution. Spraying often provides uneven deposition, particularly for wide paper webs typically used in papermaking. Spraying is also sensitive to air currents which may affect uniformity of deposition. Certain treating agents may not be used for environmental reasons due to risk of being spread through the air.

Various high-solids compositions have been developed attempting to alleviate drying restrictions enabling increased application rates. Foamed compositions have been used since volumetric expansion of the composition for obtaining uniform coverage is provided by using gas in place of liquid reducing the need for drying operations.

The application of foamed treating compositions to fibrous substrates, such as paper, is described in U.S. Pat. No. 4,263,344 (Radvan et al.), using any operative surfactant. Such foams have limited utility in applying treating compositions to the surface of paper and limited suitability for use on sized paper due to undesirable wetting or detergent action of traditional surfactants on the paper size. To overcome such difficulties, U.S. Pat. No. 4,184,914 (Jenkins) describes foamed paper treating compositions containing a hydrolyzed protein foaming agent. Such foams, however, are heat sensitive and require careful control of processing and application conditions. Furthermore, protein-based foams are not satisfactory for applying certain performance chemicals such as high-viscosity starches and cellulose derivatives to paper during papermaking operations due to the poor flow characteristics and high stability of such foams. Alternatively, U.S. Pat. No. 4,353,993 (McCrossin) describes rosin-based foamed treating compositions for surface applications to fibrous substrates.

These foam systems, however, are not fast breaking but are designed to provide foamed treating compositions used as a pond or reservoir using traditional application means, such as air-knives, rolls, brushes or the like, followed by subsequent disintegration of the foam using squeeze rolls, doctoring blades or the like. The effective use of such foam application procedures requires foamed treating compositions of sufficient stability such that when exposed to air the foam does not randomly or unevenly break down to liquid causing uneven wetting of the substrate and/or uneven doctoring by blade or squeeze rolls used in the traditional application procedures. Furthermore, recycling of foam compositions to maintain composition consistency is usually difficult and impractical where applications involving the presence of more than one paper treating agent.

Foamed treating compositions for application to fabrics is described in U.S. Pat. No. 4,099,913 (Walter et al.). Such foamed formulations are designed for use in a closed system foam applicator, such as described in U.S. Pat. No. 4,023,526 (Ashmus et al.). The described foamed treating compositions provide fast-breaking, fast-wetting, limited stability foam which reverts to liquid on contact with the substrate, providing uniform application of treating agent using high solids compositions without recycle or spillage. The application of such systems to various paper treatment is limited, however, due to interference with treated paper properties and difficulties in subsequent processing of treated paper, such as printing and certain performance finishes, due to the presence of the described foaming agents.

There is therefore a need for paper treating compositions which provide effective, uniform application for a broad selection of paper treating agents, over a wide range of composition viscosities, concentrations and the like, independent of substrate properties and application rate, which provide treated paper comparable with such treated paper, but which is substantially free of foaming agent.

SUMMARY OF THE INVENTION

This invention pertains to foamable, paper treating compositions, processes for treating paper using such compositions and to treated paper produced using such compositions and processes. The foamable, paper treating composition comprises (1) liquid vehicle, (2) paper treating agent and (3) an effective amount of foaming agent which is a fatty acid, fatty phosphate ester, reaction product of ammonium compound and fatty acid or fatty phosphate ester, fatty amine oxide or fatty amido betaine which provides a fast-breaking, fast wetting, limited stability foam of uniform structure. The process for treating paper comprises the following essential steps. A first step comprises (I) providing a liquid treating composition comprising (1) liquid vehicle, (2) paper treating agent and (3) a select amount and class of foaming agents, as described previously. A second step comprises (II) producing fast-breaking, fast-wetting, limited stability foam of uniform structure by mixing controlled quantities of the liquid treating composition with gas in foam generation means. A third step comprises (III) applying the foam to paper web moving across foam application means sufficient to provide a uniform distribution of the paper treating agent on the paper web.

The treated paper comprises paper substrate, paper treating agent and an applied amount of select foaming agent as previously described. The treated paper is comparable to such paper but which is substantially free of foaming agent.

DETAILED DESCRIPTION OF THE INVENTION

This invention provides fluid treating compositions and processes for treating paper, as well as treated paper derived from such processes and compositions, which enable the uniform distribution of treating compositions onto paper webs, such as produced during high speed papermaking and finishing operations. Such compositions and processes are effective for a wide range of paper treating agents and concentrations. The application conditions, including temperature, can be varied over a wide range. The paper can be treated relatively independently of the paper properties, including porosity, wettability, and independently of the rate of fluid treating composition application and paper speed. Treated paper is provided with minimal interference in properties and performance due to the presence of the applied amount of foaming agent.

The foamable paper treating composition of this invention is a liquid treating composition consisting essentially of liquid vehicle, paper treating agent and select foaming agent. The liquid vehicle is generally required as a carrier to assist in the deposition of the paper treating agent onto the paper web. The paper treating agent is the active material which is distributed onto the paper web by the process of this invention. The paper treating agent and foaming agent may be provided in the liquid vehicle in any form, such as by dispersion, emulsification, solvation, or other means known in the art.

The particular type of liquid vehicle is not critical so long as it performs the function of assisting deposition of the paper treating agent onto the paper web. Illustrative liquid vehicles include water, organic solvents, and the like materials which are compatible with paper, and preferably papermaking and finishing operations. Water is the preferred liquid vehicle.

The paper treating agent used in this invention, pertains to the class of materials recognized by those skilled in the art as having utility when applied to paper substrates. Typical paper treating agents include functional and performance chemical additives for paper, such as product performance and process performance chemicals. Illustrative paper treating agents include sizing aids such as starches, casein, synthetic resins including polyvinyl alcohol, animal glue, and the like materials which may be applied to the pulped slurry or the formed paper sheet during papermaking or finishing operations; binders, including wet strength or dry strength resins, such as polymers and copolymers of acrylamide, acrylonitrile, polyamide, polyamine, polyester, styrene, ethylene, acrylic acid, acrylic esters and materials such as rosin, modified gums, glyoxal and the like; coloring agents including dyes such as the class of direct, reactive, or fluorescent dyes, and pigments such as titanium dioxide or the like whitening agents, or organic color types, which are commonly used to color paper; oil or water repellants; defoamers which do not render the foaming agent of this invention inoperative; opacifiers such as clay; fillers; slimicides; latex; saturants; wax emulsions; and the like. Blends of more than one paper treating agents may be used.

Preferred paper treating agents include sizing aids such as starch, binders including wet or dry strength resins such as polymers of maleic acids, and coloring agents such as dyes or pigments, and combinations thereof.

The concentrations of paper treating agent is not critical so long as an effective amount is provided to the paper web to provide treated paper having the desired properties, based on well-established practices in the art. The particular concentration of paper treating agent desired will vary depending upon the particular type of paper treating agent, rate of foam application, rate of moving paper, paper properties and the like considerations, which determine the amount of paper treating agent desired on the treated paper. Typically, the compostions will contain between about 1 to about 70, preferably from about 2 to about 50, and most preferably from about 4 to about 30, weight percent paper treating agent.

The select foaming agent of this invention is selected from the class of fatty acid, fatty phosphate ester, reaction product of ammonium compound and fatty acid or fatty phosphate ester, fatty amine oxide or fatty amido betaine which provides a fast-breaking, fast-wetting, limited stability foam of uniform structure. The foaming agent utilized provides treated paper comparable to similar treated paper but which is substantially free of the foaming agent.

As used in the context of this invention, treated paper is provided which is comparable, i. e. substantially similar, in performance and properties with similarly treated paper which is substantially free of the foaming agent. As such, the presence of the applied amount of foaming agent provides minimal interference or reduction in the performance of the treated paper. Specifically, minimal reductions in paper strength and surface properties, such as measured by water drop contact angle and wax pick values, are provided using the foam compositions of this invention.

The foaming agents of this invention include, but are not limited to, compounds selected from the group consisting of: (a) fatty carboxylic acid; (b) fatty sulfonic acid; (c) mono- or disubstituted fatty phosphate ester or complex thereof; (d) mono- or disubstituted fatty polyoxyethylene phosphate ester or complex thereof; (e) fatty sarcosine; (f) N-fatty beta amino propionic acid; (g) fatty dicarboxylic acid or partial anhydride thereof; (h) the reaction product of any of the compounds in (a)-(g) with ammonium compound; (i) fatty amine oxide; and (j) fatty amido betaine.

As used in the context of this invention, the term "fatty" covers straight and branched chain, saturated and unsaturated, acyclic, aliphatic hydrocarbon groups, such as alkyl or alkenyl groups or the like, which have at least 6, preferably from about 8 to about 20, and most preferably from about 12 to about 16, carbon atoms. Such hydrocarbon groups may be unsubstituted or substituted with side groups, such as halogens, which do not interfer with the operation of this invention.

The free acid component of foaming agents used in this invention may be reacted with ammonium compound, such as ammonium hydroxide, up to a neutral or basic pH. The adjusted pH will preferably range from about 7 to about 11, and most preferably about 7.5 pH. In a preferred embodiment, pH adjustments provide improved fluid treating compositions having lower minimun foam densities, greater maximum foaming temperatures or both.

Illustrative foaming agents include: cocoyl, octadecyl, decyl, dodecyl, tetradecyl, hexadecyl, octadecyl, eicosyl, and the like fatty derivatives of (1) acids, including carboxylic acid, sulfonic acid, mono- or di-substituted (polyoxyethylene) acid, phosphate esters or complexes thereof, sarcosine, beta amino propionic acid, dicarboxylic acid or partial anhydride thereof, the reaction product of such acids with ammonium compound; (2) amino oxide or (3) amido betaine.

Preferred foaming agents include: cocyl sarcosine, n-dodecyl amido betaine, cocodimethyl amine oxide, n-cocobeta amino propionic acid, dicarboxylic coconut acid, ammonium lauroyl sarcosine, long-chain mono- and dialkyl acid phosphate, long-chain mono- and dialkyl phenoxy poly(oxyethylene) acid phosphate, long-chain mono- and dialkyl phosphate ester complex, dodecyl benzene sulfonic acid, 9,10-octadecenoic acid, dodecanoic acid, tetradecanoic acid, hexadecanoic acid and lauryl dimethylamine oxide.

The concentration of foaming agent in the composition is an effective foaming and noninterfering amount which is sufficient to provide a fast-breaking, fast-wetting, relatively low stability foamed treating composition of uniform structure, as well as minimal interference in the properties of the treated paper. The amount of foaming agent will vary depending upon the particular foaming agent, particularly paper treating agent, foam structure, rate of foam application, rate of moving paper, and the like considerations which vary among applications. Typically, the amount of foaming agent is between about 0.01 to about 5, preferably from about 0.05 to about 3, and most preferably from about 0.1 to about 2.0, weight percent of the liquid treating composition.

Additional adjuvants may optionally be provided to the fluid treating composition consistent with those practices established in the art. Such adjuvants include pH control agents, such as neutralizing compounds; wetting agents; foam stabilizers such as hydroxyethyl cellulose or hydrolyzed guar gum; heat sensitizers; setting agents; dispersants; screening agents; antioxidants; and the like, to the extent that such adjuvants do not unduly affect the desired foam properties or application of treating agent to the paper web. The concentration of adjuvants which may be provided follows those practices established in the art.

The particular sequence of addition of components in the treating composition is not critical, but may be achieved by mixing a liquid vehicle, paper treating agent, foaming agent, and other optional additives in any desired sequence, following those practices in the art.

The foam used in this invention contains gas and the foamable liquid treating composition. The gas is required as the vapor component of the foam. The gas may be any gaseous material capable of forming a foam with the liquid treating composition. Typical gas materials include air, nitrogen, oxygen, inert gases, or the like. Air is the preferred gas. The relative proportion of liquid treating composition to gas is not critical beyond that amount effective to provide the required uniform foam structure.

The foam of this invention is fast-breaking, fast-wetting, and has limited stability. The foam is fast-breaking having limited stability in that the foam reverts substantially immediately to liquid upon contact with the substrate. The foam is fast-wetting in that the fluid treating composition is rapidly adsorbed onto the surface, and penetrates into, the paper web. The foam has a uniform structure in that the treating composition, including paper treating agent, is evenly distributed throughout the foam.

The foam preferably has a density, bubble size and half-life as described in U.S. Pat. No. 4,099,913 (Walter et al.), incorporated herein by reference. Typically, the density of the foam can range between about 0.005 to about 0.8, preferably 0.01 to about 0.6, grams per cubic centimeter. The foams generally have an average bubble size of between 0.05 to about 0.5, and preferably 0.08 to about 0.5, millimeters in diameter. The foam half-life is between about 1 to about 60, preferably from about 3 to about 40, minutes.

The foam is produced by foam generation means known to those skilled in the art, using commercially available foaming apparatus such as the well known static, radial or axial types. Foam generation means generally consist of a mechanical agitator capable of mixing metered quantities of gas and liquid treating composition. The foaming is controlled by adjusting the volume of gas introduced into the foaming apparatus and the rotation rate of the rotor in the foaming apparatus. The rotation rate is significant in providing a foam having the desired bubble size and half-life. The relative feed rates of the liquid treating composition in gas will determine the density of the foam.

Once produced, the foamed treating composition is applied to the paper web using foam application means comprising a closed, foam applicator sufficient to provide uniform distribution of the paper treating agent on the paper web. The foam applicator is closed in that after the foam is generated the foam is substantially contained, i.e., not exposed to the atmosphere, prior to and upon contacting the paper web. The foam applicator is designed to provide a uniform distribution of the treating liquid composition including paper treating agent, on the paper web. The foam applicator is generally a nozzle or similar apparatus. Preferred nozzle apparatus which may be used in this invention are described in U.S. Pat. No. 4,023,526 (Ashmus et al.), incorporated herein by reference, and co-filed U.S. patent application Ser. No. 715,201, filed Mar. 22, 1985 entitled "Foam Applicator Used in Paper Treatment" (Cunningham et al.), incorporated herein by reference.

The foamed treating composition is applied to the paper web by passing the paper web across the foam application means covering the nozzle or other distribution means of the foam applicator. Upon contact with the paper web, the foamed treating composition immediately breaks with the components thereof absorbed into the paper web providing a uniform distribution and penetration.

The rate at which the paper web passes across the foam applicator may vary over a wide range, covering those ranges typical in papermaking and finishing operations. Typically, the paper web will be supplied at a rate of at least about 200, preferably from about 400 to about 6000, and most preferably from about 500 to about 3500, feet per minute.

The temperature conditions at which the fluid treating composition is produced and applied to the paper web are not critical but follow the practices established in the art. Typically, the temperature may range from ambient up to 100° C. or more in cases where the paper treating agent is heated prior to and/or during application. The use of certain treating agents, including paper sizes such as starches and polyvinyl alcohols, preferably involves heated application temperatures to enhance penetration of the sizing agent into the paper web. Although foamability is generally enhanced at cool or ambient temperatures, the fluid treating compositions of this invention will preferably provide foaming at higher temperatures as required in such treating applications.

Single or multiple foam application steps may be provided. Foam may be applied to either or both sides of the paper web. In two-sided applications, the foam applicators on each side of the paper web may be supplied with the same or different foam treating compositions using one or more foam generation means. The foam treating compositions applied in multiple or two-sided applications may be the same or different, in either amount or composition, for each application step. Multiple foam application steps may be in direct succession or separated by other process steps, as may be used in typical papermaking or finishing operations.

The class of paper webs treated by this invention pertains to all paper sheet materials, including particularly paper produced in wet-laid papermaking and finishing operations. The composition and process of this invention is particularly suitable to substantially non-porous paper relatively low in permeability. Illustrative paper webs include non-porous paper such as unfinished writing paper, book paper, newsprint, linerboard, boxboard, containerboard, and the like, as well as porous papers such as tissue, filtration grade paper and the like. The paper web may have any level of moisture content from dry up to near saturation.

The paper web used in this invention may have any density typical of paper sheet materials. Generally, the paper web can have a density of between about 0.1 to about 1.2, preferably from about 0.5 to about 1.0, g/cc. Generally, the paper density may range between about 15 to about 80, preferably from about 30 to about 65, weight percent of the fiber density, depending upon the fiber weight and paper porosity. For most paper grades, the paper will typically weigh between about 0.005 to about 0.15 lb./ft.$^2$.

Although this invention is described in the context of paper treatment, the scope of the claims to this invention would extend to those substantially equivalent, fibrous sheet materials which due to low porosity, low wettability and high speed treatment operation, would be benefitted by the uniform distribution of treating agent using the fluid treating composition or process of this invention.

This invention is preferably applicable to comtinuous treatment, such as used in typical papermaking and finishing operations.

In a typical embodiment, measured amounts of paper treating agent and foaming agent are mixed with a measured amount of liquid vehicle to provide the foamable paper treating composition. The composition is mixed with gas in commercially available foam generation means to produce fast-breaking, fast-wetting, limited low stability foam of uniform structure. The foam is passed to a closed, foam applicator sufficient to provide a uniform distribution of foam to a nozzle contacting and moving web such that a uniform distribution of paper treating agent is applied on the paper web. The treated, paper web is then recovered using standard practice.

A treated paper produced by this invention has a substantially uniform distribution of an applied amount of paper treating agent and foaming agent on the paper. The applied amount of foaming agent provides minimal interference in the properties of the treated paper, demonstrated by comparing the treated paper with similarly treated paper but which is substantially free of the foaming agent.

The applied amount of paper treating agent is not critical but follows the established practices in the art, in providing an effective amount for obtaining the desired properties of the treated paper. Typically, between about 0.01 to about 100, preferably from about 0.1 to about 50 and most preferably from about 0.2 to about 10, g/m$^2$ of paper-treating agent are applied to the paper web with variations in amount depending upon the particular treating application. The applied amount of foaming agent is such that minimal interference in the properties of the treated paper is provided. The maximum applied amount will vary depending upon the particular foaming agent and the particular paper web. Generally, the maximum applied amount is less than the amount of foaming agent which would provide significant interference in the properties of the treated paper. The maximum amount of foaming agent causing such interference can be readily ascertained using standard analysis of the paper properties. Typically, the applied amount of foaming agent is between about 0.001 to about 0.5, preferably from about 0.005 to about 0.01, and most preferably from about 0.01 to about 0.05 weight percent, of the treated paper. Depending upon the number and extent of treating applications the applied amount of foaming agent will typically range between less than about 0.001 to about 0.5 weight percent of the treated paper.

In a preferred embodiment, treated paper produced using the fluid treating compostions of this invention containing starch sizing as paper treating agent, provide coating performance properties, such as water drop contact angle and wax pick values, comparable in performance to such paper containing comparable treating agent but which is substantially free of foaming agent.

It was unexpectedly discovered that a class of foaming agents can be applied in such amounts using the process of this invention which are sufficient in providing a foam treating composition effective in applying a uniform distribution of paper treating agent onto paper web, balanced with minimal interference with the properties of the treated paper. Comparable performance and properties of treated paper produced by this invention can include the following performance tests: CD (cross direction) tear factor, MD (machine direction) breaking length, MD stretch, Gurley porosity, MD stiffness, opacity, light scatter coefficient, folds, K&N ink holdout, as well as wax pick and water drop contact angle properties.

The following examples are illustrative of some embodiments of this invention, and are not intended to limit the scope thereof.

EXAMPLES

The designations used in the examples have the following meanings:

| Designation | Description |
|---|---|
| Foaming Agent I | Cocoyl sarcosine |
| Foaming Agent II | n-dodecyl amido betaine |
| Foaming Agent III | Cocodimethyl aminene oxide |
| Foaming Agent IV | N—coco beta amino propionic acid |
| Foaming Agent VC | Sodium dodecylbenzene sulfonate |
| Foaming Agent VIC | Ten-mole ethoxylate of dodecyl mercaptan. |
| Foaming Agent VIIC | Polyoxyethylene linear alcohol product distributed under the tradename Texwet TM 1048 by Intex Products Inc. |
| Foaming Agent VIII | A dicarboxylic coconut acid distributed under the tradename Miranol TM C2M by Miranol Chemical Inc. |
| Foaming Agent IXC | Sodium salt of a dicarboxylic coconut acid distributed under the tradename Miranol TM C2M-SF by Chemical Inc. |
| Foaming Agent XC | An amine oxide product blend distributed under the tradename Uscowet TM FA-43 by SUS Chemical Co., Inc. |
| Foaming Agent XIC | Sodium salt of N—coco beta amino propionic acid. |
| Foaming Agent XIIC | A coco betaine distributed under the tradename Deriphat TM AB-45 by Henkel Corp. |
| Foaming Agent XIII | Ammonium lauroyl sarcosine. |
| Foamimg Agent XIVC | Mono- and diglyceride of citric acid. |

-continued

| Designation | Description |
|---|---|
| Foaming Agent XV | Coco acid ester of sodium isetnionate distributed under the tradename Igepon AC-78 by GAF Corp. |
| Foaming Agent XVI | A long chain mono- and dialkyl acid phosphate distributed under the tradename Fosterge TM Acid by Henkel Corp. |
| Foaming Agent XVII | A long chain mono- and dialkyl phenoxy poly(oxyethylene) acid phosphate distributed under the tradename Fosterge TM LF Acid by Henkel Corp. |
| Foaming Agent XVIII | A long chain mono- and dialkyl phosphate ester complex distributed under the tradename Gafac TM RD-510 by GAF Corp. |
| Foaming Agent XIX | Dodecyl benzene sulfonic acid. |
| Foaming Agent XX | A long chain mono- and dialkyl phosphate ester complex distributed under the tradename Concofac TM 690 by Continental Chemical Co. |
| Foaming Agent XXI | 9,10-octadecenoic acid |
| Foaming Agent XXII | Dodecanoic acid |
| Foaming Agent XXIII | Tetradecanoic acid |
| Foaming Agent XXIV | Hexadecanoic acid |
| Foaming Agent XXV | Lauryl dimethyl amine oxide |
| Tracer I | Fluorescent dye distributed under the tradename Leucophor TM AC by Sandoz Colors and Chemicals Co. |
| Treating agent I | Oxidized starch distributed under the tradename Stayco TM M by A. E. Staley Manufacturing Co. |
| Treating Agent II | Hydroxyethylated starch distributed under the tradename Penforo TM Gum 280 by Penick & Ford, Inc. |

The treated paper produced in the examples was tested using well established procedures as follows:

| Test | Procedure Used |
|---|---|
| Water drop contact angle | TAPPI Test Method T-458 |
| Moisture content | TAPPI Test Method T-412 |
| Wax pick value | TAPPI Test Method T-459 |
| Viscosity | Brookfield viscosity determined using a Brookfield Model RVF viscometer at the appropriate spindle and speed following standard practice. |
| Minimum foam density | An evaluation of the foamability of the foam composition using a Model 4MHA Oakes foamer to determine the minimum liquid treating composition to gas ratio before foam breakdown. |

The water drop contact angle test measures the degree of wettability of a surface, such as paper web, by distilled water. The test provides an indication of the potential performance of the surface in subsequent processing operations such as printing.

The wax pick value test measures the surface strength of treated paper indicating the resistance to "picking" or fraying such as during printing operations.

Unless indicated otherwise all concentration percentages are in weight percent, i.e., wt. %.

EXAMPLE 1

A series of paired compositions were prepared, containing 1 wt. % of the designated foaming agents with one composition containing an additional 5 wt. % of typically cooked starch as Treating agent I.

Draw-down methods were used to coat the non-starch liquid composition and the Hobart Kitchen-aide foamed starch composition onto internally sized vellum paper weighing about 89.6 g/m$^2$, and having a moisture content of from 5.2-5.7 wt. %. The treated paper was then dried at 150° for 3 minutes, cooled and tested for distilled water drop contact angle. The results are displayed in Table I.

TABLE I

| Foaming Agent | Water Drop Contact Angles Without Starch | With Starch |
|---|---|---|
| None-untreated paper | 90° | — |
| None-water only | 89° | — |
| Foaming Agent I | 85° | 88° |
| Foaming Agent II | 89° | 63° |
| Foaming Agent VIIC | 87° | 60° |
| Foaming Agent VC | 0° | — |
| Foaming Agent VIC | 0° | 0° |
| Foaming Agent III | 54° | — |
| Foaming Agent IV | — | 89° |

This example demonstrates the unpredictability in materials that can serve as foaming agents which may or may not in combination with starch provide good water resistance on paper treated with fluid treating compositions containing such materials.

EXAMPLE 2

A starch composition of 12% solids was prepared by cooking a 20% concentration of Treating agent I for 30 minutes at about 90° C. and subsequently diluting to 12% total solids with cold tap water, a series of test solutions were made by adding the designated foaming agents to the starch solutions at a 1% concentration level based on the as-received foaming agent materials.

Each composition was fed through a 4 inch diameter radial type Oakes Foamer and the generated foam applied to the paper as in Example 1 using standard draw-down procedures. The treated paper samples were then dried at 150° C. for 3 minutes in a forced air oven for water drop contact angle testing. In addition, the liquid composition viscosity was measured and the minimum foam density obtainable from each solution was measured by adjusting the air flow to the foamer. The results are summarized in Table II.

TABLE II

| Foaming Agent | Viscosity (cp) | Water Drop Contact Angle | Minimum Foam Density (gm/cc) | Quality[a] |
|---|---|---|---|---|
| VIII | 600 | 90° | 0.089 | Excellent |
| IXC | 1000 | 55° | 0.065 | Viscous |
| XC | 400 | 0° | 0.048 | Good |
| II | 960 | 42° | 0.085 | Good |
| IV | 440 | 62° | 0.056 | Good |
| XIC | 1900 | 33° | 0.040 | Excellent |
| XIIC | 1080 | 32° | 0.089 | Excellent |
| XIII | 1140 | 60° | 0.065 | Good |
| XIVC | 200 | — | 1.0 | None |
| XV | 1940 | 88° | 0.035 | Excellent |
| XVI | 110 | 90° | 0.038 | Excellent |
| XVII | 85 | 90° | 0.027 | Excellent |

TABLE II-continued

| Foaming Agent | Viscosity (cp) | Water Drop Contact Angle | Minimum Foam Density (gm/cc) | Quality[a] |
|---|---|---|---|---|
| XVIII | 125 | 67° | 0.026 | Excellent |

[a]Foam quality is a visual rating of bubble uniformity.

This example demonstrates that certain salts of acids that provide good quality foams introduce undesirable viscosity side effects and/or reduce water drop contact angles to an undesirable degree. Also, the minimum density of foam that can be generated varies with the different foaming agents.

EXAMPLE 3

In this example, the efficiency of the foaming agents was tested in a 12 wt. % starch solution of Treating agent I at elevated temperatures, as well as over a range in pH. The foaming agents were used with and without pH adjustment up to about pH 7.5 using an aqueous solution containing 10 wt. % ammonium hydroxide.

The results are set forth in Table III along with the minimum foam density and the maximum temperature of foaming.

TABLE III

| Foaming Agent | Wt. % Added | pH as Added | Maximum Temp. of Foaming °C. | Minimum Foam Density (gm/cc) |
|---|---|---|---|---|
| VIII | 1.0 | 4.3 | 25° | 0.089 |
| VIII | 1.0 | 4.3 | 50° | No foam |
| VIII | 0.5 | 7.6 | 83° | 0.046 |
| XVII | 0.25 | 2.2 | 50° | 0.068 |
| XVII | 0.5 | 2.2 | 70° | 0.068 |
| XVII | 0.5 | 7.6 | 82° | 0.036 |
| XIX | 0.25 | 1.0 | 50° | 0.182 |
| XIX | 0.50 | 1.0 | 55° | 0.13 |
| XIX | 0.5 | 7.6 | 82° | 0.037 |
| XX | 1.0 | 1.9 | 60° | 0.06 |
| XX | 0.5 | 7.4 | 83° | 0.06 |
| XVI | 0.5 | 1.9 | 82° | 0.022 |
| XVI | 0.1 | 1.9 | 75° | 0.215 |
| XVI | 0.5 | 7.4 | 82° | 0.027 |

This example, alone and in combination with Examples 1 and 2, demonstrates that foam treating compositions of this invention are suitable for use in a typical papermaking operation.

EXAMPLE 4

A starch treating composition was prepared by cooking 30 wt. % Treating agent I in water for about 30 minutes at about 90° C. The composition was diluted to 20 wt. % starch and held thereafter at about 75° C. Sufficient Foaming agent XIII was added to the composition to provide about 0.12 wt. %.

The composition containing 0.025 wt. % added Tracer I was foamed using an 8-inch radial type foam generator, with liquid metering pump, metered compressed air supply, and a foam applicator as consisting of a foam distribution chamber, a foam application chamber fitted with a pressure gauge and foam applicator nozzle lips, suitably jacketed to enable maintenance of foam temperature at about 75° C. The foamed composition was applied to an internally sized paper sheet weighing about 89.6 g/m$^2$ weight under the following conditions and tested with the results described in Table IV.

TABLE IV

| Process Conditions and Analysis | |
|---|---|
| Paper sheet speed | 1500 ft/min |
| Wet coat weight | 10.8 g/m$^2$ |
| Dry coat weight | 1.15 g/m$^2$ |
| Foam pressure | 0.22 psi |
| Foam density | 0.34 g/cc |
| Foam temperature | 75° C. |
| Sample drying | 150° C., 3 minutes |
| Water drop contact angle | 85°[a] |
| Wax pick value | 14[b] |

[a]Untreated paper test value of 90°.
[b]Untreated paper test value of 6.

This example shows the effective results gained from the use of a proper foaming agent at a suitable level on a hot starch solution at typical papermaking operating conditions. Excellent water contact angle is retained and substantially improved wax pick value are obtained compared to the untreated paper control.

EXAMPLE 5

In this example, four food-grade fat acids were converted to soaps with ammonium hydroxide in the traditional soaping manner. Each soap so prepared was added as the designated foaming agents to a hot 12% solids starch solution of Treating agent I containing 0.025 wt.% Tracer I. Each foamable solution was processed through the same equipment as described in Example 4 and applied to an internally sized paper weighing about 89.6 gm/m$^2$. The process conditions and the test results are shown in Table V.

TABLE V

| | Foaming Agent | | | |
|---|---|---|---|---|
| | XXI | XXII | XXIII | XXIV |
| Weight % in Mix | 0.33 | 0.25 | 0.25 | 0.33 |
| Paper speed (ft/min) | 1500 | 1500 | 1500 | 1500 |
| Wet coat wt. (g/m$^2$) | 10.8 | 10.8 | 10.8 | 10.8 |
| Dry coat wt. (g/m$^2$) | 1.3 | 1.3 | 1.3 | 1.3 |
| Foam pressure (psi) | 1.01 | 2.96 | 1.99 | 2.09 |
| Foam density (g/cc) | 0.32 | 0.31 | 0.30 | 0.32 |
| Foam temperature (°C.) | 70° | 70° | 70° | 70° |
| Sample drying | 150° C., 3 min. | 150° C., 3 min. | 150° C., 3 min. | 150° C., 3 min. |
| Water drop contact angle | 59° | 53° | 65° | 79° |
| Wax pick value | 16 | 11 | 14 | 14 |

This example demonstrates the utility of select recognized food grade materials used in the composition and process of this invention.

EXAMPLE 6

A 12 wt. % solids composition of Treating agent I was prepared by a typical cooking procedure to which was added 0.025 wt.% Tracer I. An aqueous solution of 30 wt.% Foaming agent XXV was added to the hot starch solution so as to provide about 0.12 wt.% foaming agent. The process and equipment described in Example 4 was used to coat an internally sized paper weighing about 89.6 g/m$^2$. The process conditions and test results are described in Table VI.

TABLE VI

| | |
|---|---|
| Paper sheet speed | 1500 ft/min |
| Wet coat weight | 10.8 g/m$^2$ |
| Dry coat weight | 1.3 g/m$^2$ |
| Foam pressure | 0.87 psi |
| Foam density | 0.20 g/cc |
| Foam temperature | 70° C. |

TABLE VI-continued

| | |
|---|---|
| Sample drying | 150° C., 3 min |
| Contact angle | 77° |
| Wax pick value | 14 |

This example illustrates the use of a very low level of a cationic type foaming agent for providing treated paper.

EXAMPLE 7

A 12% Treating agent I starch composition was prepared by a typical cooking procedure to which was added an aqueous solution providing 0.025 wt. % Tracer I. A 20 wt. % mixture of Foaming agent XIX in hot water was raised to pH 7.5 with 28 wt. % ammonium hydroxide. A sufficient amount of this solution was added to the hot starch mix to provide 0.20 wt. % Foaming agent XIX in the starch mix. The process and equipment described in Example 4 was used to coat an internally sized paper weighing about 89.6 grams per square meter. The process conditions and test results are described in Table VII.

TABLE VII

| | |
|---|---|
| Paper sheet speed | 1500 ft/min |
| Wet coat weight | 10.8 g/m$^2$ |
| Dry coat weight | 1.3 g/m$^2$ |
| Foam pressure | 2.17 psi |
| Foam density | 0.30 g/cc |
| Foam temperature | 70° |
| Sample drying | 150° C., 3 min. |
| Contact angle | 76° |
| Wax pick value | 14 |

This example demonstrates the use of a very low level of foaming agent for foam treating compositions useful in treating paper. Compared with Example 3 it is demonstrated that the foaming agent can be used either in its free acid form or as an ammonium reaction product.

EXAMPLE 8

Sufficient Foaming agent XVI was added to the treating composition described in Example 7 to provide 0.50 wt. % foaming agent. The process and equipment described in Example 4 was used to coat an internally sized paper weighing about 89.6 g/m$^2$. The process conditions and test results are described in Table VIII.

TABLE VIII

| | |
|---|---|
| Paper sheet speed | 1500 ft/min |
| Wet coat weight | 10.8 g/m$^2$ |
| Dry coat weight | 1.3 g/m$^2$ |
| Foam pressure | 1.88 psi |
| Foam Density | 0.32 g/cc |
| Foam temperature | 65° |
| Sample drying | 150° C., 3 min. |
| Contact angle | 87° |
| Wax pick value | 13 |

This example illustrates the effective use of a low level of a fatty phosphate as foaming agent. Compared with Example 3, It is demonstrated that the foaming agent may be used either in its free state or as an ammonium reaction product.

EXAMPLE 9

In this example, paper, as used in Example 1 was pre-treated with water and plastic wrapped for several days to provide a wetted paper having a moisture content of 19%.

The wetted paper was treated following the hot foamed treating composition preparation process and apparatus as described in Example 4 under the conditions described in TABLE IX.

TABLE IX

| | |
|---|---|
| Paper moisture content | 19% |
| Paper sheet speed (ft/min) | 1500 |
| Treating agent 1 (wt. %) | 12 |
| Foaming agent (wt. %) | XIX (0.25) |
| Wet coat weight (g/m$^2$) | 10.8 |
| Dry coat weight (g/m$^2$) | 1.3 |
| Foam pressure (psi) | 0.58 |
| Foam density (g/cc) | 0.28 |
| Foam temperature | 66° C. |
| Paper temperature | Ambient |
| Coating uniformity | Good |

This example demonstrates that the process and foam compositions of this invention provide for the uniform sizing of paper independent of the moisture level in the paper web being treated.

EXAMPLE 10

A series of Treating agent I starch compositions containing different starch concentrations were prepared by the customary cooking procedure. An aqueous solution providing 0.025 weight percent Tracer I was added to each starch solution. Foaming agent XIX which had been ammonium hydroxide neutralized in a water solution was added to each composition. Using the process and apparatus as described in Example 4, the foam composition was applied to an internally sized paper sheet weighing about 89.6 g/m$^2$. The process details are displayed in Table X.

TABLE X

| | | | | |
|---|---|---|---|---|
| Treating agent I (wt. %) | 25 | 16 | 12 | 6 |
| Foaming agent (wt. %) | 0.5 | 0.5 | 0.15 | 0.25 |
| Paper speed (ft/min) | 1500 | 1500 | 1500 | 2500 |
| Wet coat wt. (g/m$^2$) | 4.5 | 4.5 | 10.8 | 10.8 |
| Dry coat wt. (g/m$^2$) | 1.1 | 0.7 | 1.3 | 0.6 |
| Foam pressure (psi) | 1.19 | 0.72 | 0.18 | 0.04 |
| Foam density (g/cc) | 0.10 | 0.18 | 0.42 | 0.41 |
| Foam temperature (°C.) | 75 | 64 | 70 | 70 |

This example illustrates the utility of foam compositions of the instant invention over a range of, but not the limits of, composition concentrations and applied amounts of treating agents.

EXAMPLE 11

A series of Treating agent I compositions containing different starch solids concentrations were prepared by the normal cooking procedure. An aqueous solution providing 0.025 weight percent Tracer I was added to each composition. Foaming Agent II was added to each composition which was applied using the process and apparatus described in Example 4, to an internally sized paper sheet weighing about 89.6 g/m$^2$, under the conditions described in Table XI as follows:

TABLE XI

| | | | | | | | | |
|---|---|---|---|---|---|---|---|---|
| Treating agent I (wt. %) | 25 | 16.7 | 12.0 | 8.8 | 4.6 | 4.0 | 12 | 12 |
| Foam agent (wt. %) | 0.40 | 0.46 | 0.80 | 0.26 | 0.24 | 0.4 | 0.8 | 0.8 |
| Paper speed (ft/min) | 1500 | 2300 | 1000 | 1200 | 1600 | 500 | 1500 | 2300 |
| Wet coat wt. (g/m$^2$) | 4.5 | 7.5 | 16.1 | 15.2 | 19.7 | 5.0 | 10.8 | 10.8 |
| Dry coat wt. (g/m$^2$) | 1.1 | 1.2 | 1.9 | 1.3 | 0.9 | 0.2 | 1.3 | 1.3 |
| Foam pressure (psi) | 0.29 | a | 1.81 | 1.81 | 2.17 | 1.37 | 1.81 | 1.81 |
| Foam density (g/cc) | 0.5 | 0.4 | 0.5 | 0.35 | 0.38 | 0.03 | 0.032 | 0.72 |
| Foam temperature °C. | 70 | 25 | —[a] | 25 | 25 | 25 | 25 | 25 |

[a]—not determined

This example describes the usefulness and versatility of the compositions and process of this invention over ranges of, but not the limits of, treating agent concentrations and applied amounts, process rates and foam densities.

EXAMPLE 12

Two compositions of Treating agent II were prepared via cooking at 90° C. for 30 minutes; containing 20% and 4% starch concentrations, respectively. The designated amount of foaming agent III was provided. Using the process and apparatus described in Example 4 the respective fluid treating composition was applied to (a) an internally sized paper sheet weighing 76.7 g/m$^2$ and (b) a newsprint base type paper sheet weighing about 66.5 gm$^2$, under the process conditions as described in Table XII.

TABLE XII

| Paper type | Writing | newsprint |
|---|---|---|
| Paper weight (g/m$^2$) | 76.7 | 66.5 |
| Paper speed (ft/min) | 1000 | 500 |
| Starch solids (wt. %) | 20 | 4 |
| Foam agent (wt. %) | 0.4 | 0.2 |
| Wet Coat wt. (g/m$^2$) | 8.6 | 5.0 |
| Dry coat wt. (g/m$^2$) | 1.8 | 0.2 |
| Foam pressure (psi) | 2.44 | 3.61 |
| Foam density (g/cc) | 0.19 | 0.06 |
| Foam temperature (°C.) | 25 | 25 |

This example describes the use of hydroxyethyl modified starch as a treating agent for this invention, and as applied to different grades of paper.

We claim:

1. A foamable paper treating composition comprising (1) liquid vehicle, (2) paper treating agent and (3) an effective amount of foaming agent which is a fatty acid, fatty phosphate ester, reaction product of ammonium compound and fatty acid or fatty phosphate ester, fatty amine oxide or fatty amido betaine which provides a fast-breaking, fast-wetting, limited stability foam of uniform structure.

2. The composition of claim 1 wherein the foaming agent is selected from the group consisting of:

(a) fatty carboxylic acid;
(b) fatty sulfonic acid;
(c) mono- or disubstituted fatty phosphate ester or complex thereof;
(d) mono- or disubstituted fatty phosphate ester or complex thereof;
(e) fatty sarcosine;
(f) N-fatty beta amino propionic acid;
(g) fatty dicarboxylic acid or partial anhydride thereof;
(h) reaction product of (a)–(g) with ammonium compound;
(i) fatty amino oxide; and
(j) fatty amido betaine.

3. The composition of claim 2 wherein the foaming agent is selected from the group consisting of: cocoyl sarcosine, n-dodecyl amido betaine, cocodimethyl amine oxide, n-coco beta amino propionic acid, dicarboxylic coconut acid, ammonium lauroyl sarcosine, long-chain mono- and dialkyl acid phosphate, long-chain mono- and dialkyl phenoxy poly (oxyethylene) acid phosphate, long-chain mono- and dialkyl phosphate ester complex, dodecyl benzene sulfonic acid, 9,10-octadecenoic acid, dodecanoic acid, tetradecanoic, hexadecanoic acid, and lauryl dimethylamine oxide.

4. The composition of claim 1 containing from about 0.01 to about 5 weight percent foaming agent.

5. The composition of claim 1 containing from about 0.05 to about 3 weight percent foaming agent.

6. A foamed, paper treating composition of uniform structure comprising the composition of claim 1 and gas.

7. The composition of claim 6 wherein the foam has a density of between about 0.005 to about 0.8 grams per cubic centimeter, an average bubble size of between about 0.05 to about 0.5 millimeter in diameter and a half life of between about 1 to about 60 minutes.

8. A process for treating paper comprising:

(I) providing a liquid treating composition comprising (1) liquid vehicle, (2) paper treating agent and (3) an effective amount of foaming agent which is a fatty acid, fatty phosphate ester, reaction product of ammonium compound and fatty acid or fatty phosphate ester, fatty amine oxide or fatty amido betaine which provides a fast-breaking, fast-wetting, limited stability foam of uniform structure;

(II) producing a fast-breaking, fast-wetting, limited stability foam of uniform structure by mixing controlled quantities of the liquid treating composition with gas in foam generation means;

(III) applying the foam to paper web moving across foam application means sufficient to provide a uniform distribution of the paper treating agent on the paper web.

9. The process of claim 8 wherein said foaming agent is sufficent to provide treated paper comparable to such treated paper but which is substantially free of foaming agent.

10. The process of claim 8 wherein said foaming agent is sufficient to provide treated paper having comparable water drop contact angle and wax pick value properties to such treated paper but which is substantially free of foaming agent.

11. The process of claim 8 wherein the foaming agent is selected from the group consisting of:

(a) fatty carboxylic acid;
(b) fatty sulfonic acid;
(c) mono- or disubstituted fatty phosphate ester or complex thereof;
(d) mono- or disubstituted fatty phosphate ester or complex thereof;
(e) fatty sarcosine;
(f) N-fatty beta amino propionic acid;
(g) fatty dicarboxylic acid or partial anhydride thereof;
(h) reaction product of (a)–(g) with ammonium compound;
)i) fatty amino oxide; and
(j) fatty amido betaine.

12. The process of claim 11 wherein the foaming agent is selected from the group consisting of: cocoyl sarcosine, n-dodecyl amido betaine, cocodimethyl amine oxide, n-coco beta amino propionic acid, dicarboxylic coconut acid, ammonium lauroyl sarcosine, long-chain mono- and dialkyl acid phosphate, long-chain mono- and dialkyl phenoxy poly (oxyethylene) acid phosphate, long-chain mono- and dialkyl phosphate ester complex, dodecyl benzene sulfonic acid, 9,10-octadecenoic acid, dodecanoic acid, tetradecanoic, hexadecanoic acid, and lauryl dimethylamine oxide.

13. The process of claim 8 containing from about 0.01 to about 5 weight percent foaming agent.

14. The process of claim 13 containing from about 0.05 to about 3 weight percent foaming agent.

15. The process of claim 8 wherein the foam application means is closed in providing a foam which is substantially contained prior to and upon contacting the paper web.

16. A treated paper produced by the process of claim 8.

17. A treated paper comprising paper substrate, paper treating agent and an applied amount of foaming agent which is a fatty acid, fatty phosphate ester, reaction product of ammonium compound and fatty acid of fatty phosphate ester, fatty amine oxide or fatty amido betaine which provides a fast-breaking, fast-wetting, limited stability foam of uniform structure, wherein the applied amount of foaming agent provides treated paper comparable to such treated paper but which is substantially free of the foaming agent.

18. The treated paper of claim 17 wherein the foaming agent is selected from the group consisting of:

(a) fatty carboxylic acid;
(b) fatty sulfonic acid;
(c) mono- or disubstituted fatty phosphate ester or complex thereof;
(d) mono- or disubstituted fatty phosphate ester or complex thereof;
(e) fatty sarcosine;
(f) N-fatty beta amino propionic acid;
(g) fatty dicarboyxlic acid or partial anhydride thereof;
(h) reaction product of (a)–(g) with ammonium compound;
(i) fatty amino oxide; and
(j) fatty amido betaine.

19. The treated paper of claim 17 wherein the foaming agent is selected from the group consisting of: cocoyl sarcosine, n-dodecyl amido betaine, cocodimethyl amine oxide, n-coco beta amino propionic acid, dicarboxylic coconut acid, ammonium lauroyl sarcosine, long-chain mono- and dialkyl acid phosphate, long-chain mono- and dialkyl phenoxy poly (oxyethylene) acid phosphate, long-chain mono- and dialkyl phosphate ester complex, dodecyl benzene sulfonic acid, 9,10-octadecenoic acid, dodecanoic acid, tetradecanoic, hexadecanoic acid, and lauryl dimethylamine oxide.

20. The treated paper of claim 17 containing from about 0.001 to about 0.5 $g/m^2$ foaming agent.

* * * * *

UNITED STATES PATENT AND TRADEMARK OFFICE

CERTIFICATE OF CORRECTION

PATENT NO. : 4,571,360

DATED : February 18, 1986

INVENTOR(S) : Brown et al.

It is certified that error appears in the above-identified patent and that said Letters Patent is hereby corrected as shown below:

In column 16 at line 35 "8.6" should read -- 8.8 --.

In claims 2, 11 and 18, each at line 7 after "(d) mono- or disubstituted" insert -- polyoxyethylene --, at each location.

Signed and Sealed this

Seventh Day of October, 1986

[SEAL]

*Attest:*

DONALD J. QUIGG

*Attesting Officer*

*Commissioner of Patents and Trademarks*